US005970582A

United States Patent [19]

Stover

[11] Patent Number: 5,970,582

[45] Date of Patent: Oct. 26, 1999

[54] METHOD FOR SEPARATING KENAF INTO CORE AND FIBER

[76] Inventor: Jimmy R. Stover, 6610 Hunt, Corpus Christi, Tex. 78413

[21] Appl. No.: 09/281,038

[22] Filed: Mar. 30, 1999

[51] Int. Cl.[6] ..... D01B 1/10

[52] U.S. Cl. ..... 19/5 R; 19/24; 19/33; 241/7; 241/13; 241/159

[58] Field of Search ..... 19/5 A, 5 R, 9, 19/10, 24, 25, 26, 27, 28, 29, 30, 33, 39, 48 R, 40, 43, 50, 53, 54, 57, 58, 202; 241/7, 13, 159; 162/20

[56] References Cited

U.S. PATENT DOCUMENTS

| | | | |
|---|---|---|---|
| 870,838 | 11/1907 | De Perini . | |
| 1,797,507 | 3/1931 | Knowles . | |
| 2,688,161 | 9/1954 | Michel . | |
| 2,755,511 | 7/1956 | Godtel . | |
| 2,817,119 | 12/1957 | Angiolini . | |
| 4,214,348 | 7/1980 | Schwartz et al. | 19/58 |
| 4,310,950 | 1/1982 | Cox | 19/202 |
| 4,974,293 | 12/1990 | Baker . | |
| 5,507,074 | 4/1996 | Chen et al. | 19/5 R |

*Primary Examiner*—Michael A. Neas
*Assistant Examiner*—Gary L. Welch
*Attorney, Agent, or Firm*—G. Turner Moller

[57] ABSTRACT

A method and apparatus for separating kenaf into fiber and core uses a modified stick machine conventionally used in the cotton industry for removing trash from unginned cotton. Lengths of kenaf are delivered onto the periphery of a saw cylinder so the toothed wheels snag the fiber and draw the kenaf across a grate. Core is detached from the fiber, passes through the grate and is delivered to a core outlet. Fiber on the toothed wheels are removed by a doffing wheel and delivered to a fiber outlet. Multiple saw cylinder/doffing wheel assemblies are provided.

12 Claims, 5 Drawing Sheets

METHOD FOR SEPARATING KENAF INTO CORE AND FIBER

This invention relates to a method and apparatus for separating kenaf into its constituents of core and fiber.

BACKGROUND OF THE INVENTION

Kenaf is a plant of considerable potential, as yet mostly unfulfilled. It is native to central Africa and has been cultivated in Egypt for thousands of years as a source of fiber for making clothing, rugs, rope and other products, as well as for other uses. Kenaf grows to heights of 12–18 feet in a 150 day season and requires little or no pesticides or herbicides if it is grown in the right locale. Kenaf can produce 5–10 tons of dry fiber and core per acre. The plant has two distinct types of material: an outer fiber known as fiber, bast or bast fiber, comprising about one-third by weight of the plant, and a core. The core is a low density woody type material while the bast is a much lower density fluffy type fiber of high tensile strength. As harvested, the bast fibers tenaciously adhere to the core. In a typical harvested kenaf crop, the core is slightly tapered from bottom to top and has a small diameter at the top in the range of ¼–½".

The core and fibers have distinctly different uses and must be separated before they are suitable for these different uses. The core is useable as animal bedding, oil-absorbent material for oil spill cleanup, animal bedding, potting soil, kitty litter and particle board or other similar construction materials.

The most promising high volume use of bast fibers is in paper manufacture. Another potential high volume use is in the manufacture of fiberboard used in automotive door panels and the like. The economics of bast fibers in these high volume situations are attractive because the cost of the cultivated crop compares very favorably to the cost of timber which is the conventional source of fiber used in paper and fiberboard production. The difficulty has been in separating the core from the bast fibers in large quantities. Many different attempts have been made, all heretofore futile, to separate kenaf core from fiber on an industrial scale.

The disclosure of a kenaf separator mounted on the back of a tractor is found in U.S. Pat. No. 2,755,511. Other disclosures of interest are found in U.S. Pat. Nos. 870,838; 1,797,507; 2,688,161; 2,817,119 and 4,974,293.

SUMMARY OF THE INVENTION

In this invention, a slightly modified conventional separator used in a cotton gin, known as a stick machine, is used to separate kenaf into core and fiber. A conventional stick machine includes a series of separating stations, each station comprising a saw cylinder-grate assembly and a doffing wheel. Multistage stick machines typically have one or more arrangements comprising two saw cylinder-grate assemblies and a single doffing wheel. The saw cylinders comprise a multiplicity of toothed wheels spaced apart by disks or a toothed band fastened to a drum. The teeth snag the fibers and rotate the kenaf lengths past a grate. As the kenaf moves past the grate, the core contacts the grate and stops or slows down. The fiber, snagged on the saw teeth, continue to rotate. The core is thereby detached from the fiber and passes through the grate toward a core outlet. Fibers adhere to the saw cylinder and are removed by a doffing wheel which comprises a plurality of metal or brush type fingers. The doffing wheel is rotated faster than the saw cylinder and the fingers act to remove the fibers from the saw cylinder in the conventional manner of doffing wheels. Fibers removed from the doffing wheel move toward a fiber outlet.

In one sense, it is easier to get the fiber out of the core than to get the core out of the fiber. As shown by an inspection of the core material after the first separation stage, only a few fiber tufts are mixed with the core. These are situations where fiber tufts are stuck to small pieces of core. On the other hand, an inspection of the fiber material shows a considerable proportion of core particles. These core particles in the fiber stream universally are tenaciously adhered to the fiber. Successive separation operations may accordingly be conducted on both the fiber stream and the core stream by downstream saw cylinder-doffing wheel assemblies in order to upgrade the output.

An important feature of this invention is to break the core material before attempting separation of the core and fiber. Typically, the kenaf stalk is cut into predetermined lengths corresponding to the desired length of the bast fiber. This operation breaks the core material to some extent because it is roughly analogous to balsa wood and is thus considerably more brittle than the bast fibers. In this invention, an additional step is conducted to break the core particles before a separation stage, without cutting the bast fibers.

The conventional stick machine is modified by placing an additional strap along the upper bar of the grate. This acts to break the core loose from the saw tooth with a relatively sharp knife edge and minimizes jamming of the core in the stick machine.

Batches of kenaf, cut to a predetermined length in the range of ½–12" is fed into the inlet of a multistage stick machine. Core material is delivered from one outlet of the stick machine and fiber is delivered from the other outlet.

It is an object of this invention to provide an improved method and apparatus for separating kenaf into its constituent fiber and core.

Another object of this invention is to provide a method for separating kenaf into its constituent core and fiber on an industrial scale.

A further object of this invention to provide an improved saw cylinder-grate assembly for separating kenaf into core and fiber.

These and other objects and advantages of this invention will become more fully apparent as this description proceeds, reference being made to the accompanying drawings and appended claims.

IN THE DRAWINGS

DETAILED DESCRIPTION

Figure 1:
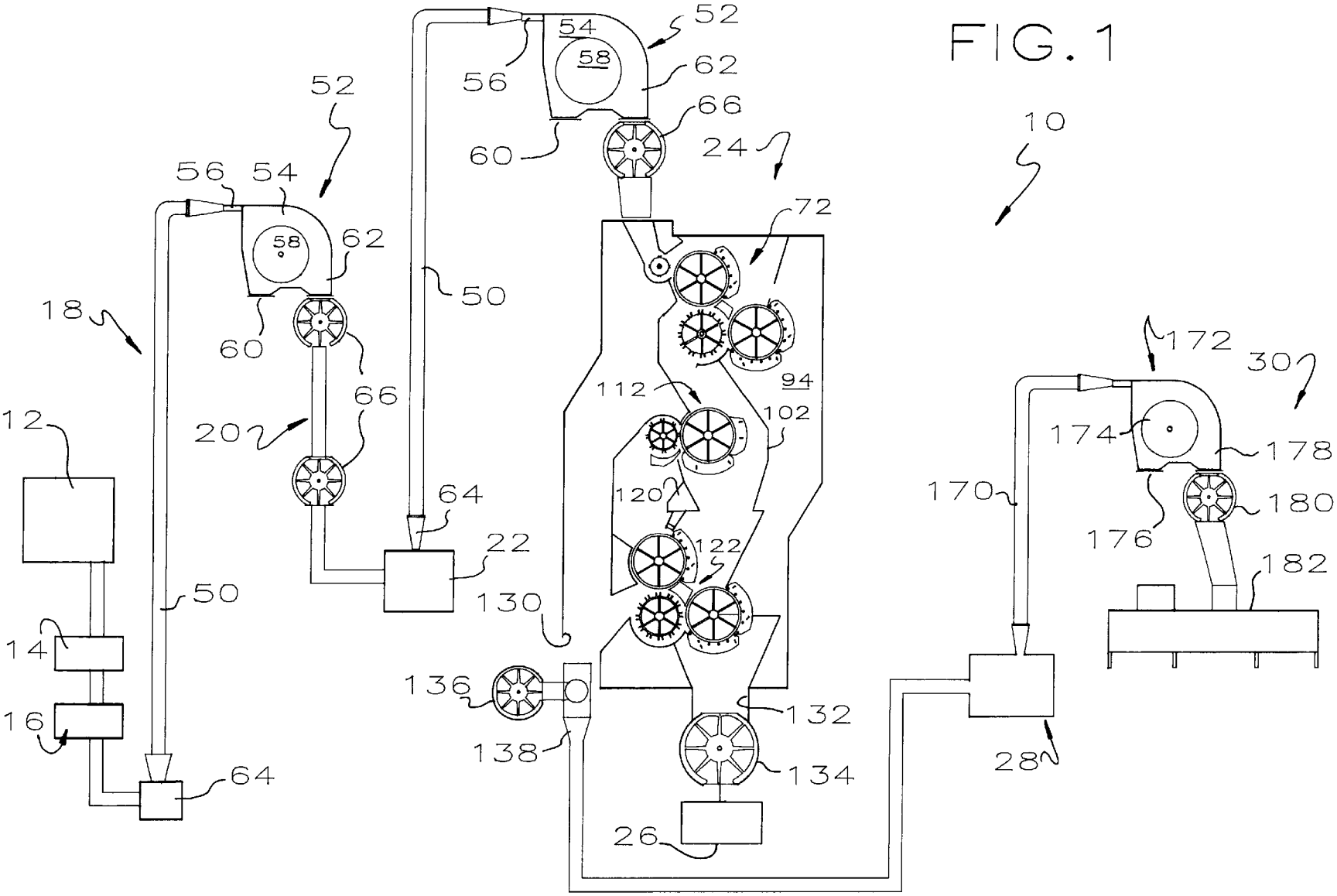
FIG. 1 is a schematic flow diagram of a kenaf processing plant.

Referring to FIGS. 1–10, a kenaf processing plant 10 is partially shown and comprises, as major components, an inlet device 12, a stalk cutter 14, a crimper 16, a conveying system 18, a feed controller 20, a dryer 22, a slightly modified stick machine 24, a core handling assembly 26, a final separating assembly 28 and a fiber handling assembly 30.

The inlet device 12 may be a hopper for receiving kenaf harvested from a field, a module feeder for receiving and disintegrating kenaf modules, suction pipes for vacuuming kenaf from a vehicle or trailer, or the like. The kenaf is cut to a predetermined length, typically ½–12", corresponding to the desired length of the bast fibers. This may be done in the field at the time of harvesting or may be done in the plant 10 by a conventional stalk cutter 14 of any suitable design of which there are many known versions.

Heretofore, attempts to separate kenaf into its constituent bast fibers and core have operated on cut lengths of kenaf stalk. This inevitably starts the separation of the core from the bast fibers because there is considerable pulling of the fiber from the core and considerable breakage of the more brittle core. Describing the core as brittle is, of course, relative. Relative to the bast fibers, the core is brittle. Relative to soft woods such as balsa, the core is not brittle and is surprisingly tough. In any event, separation of the core from the fibers is enhanced by breaking the core into smaller pieces without severing the bast fibers. This is conveniently done in a crimper 16 which comprises an important part of this invention, particularly when dealing with longer cut lengths of kenaf which correspond to longer desired lengths of fiber.

Figure 2:
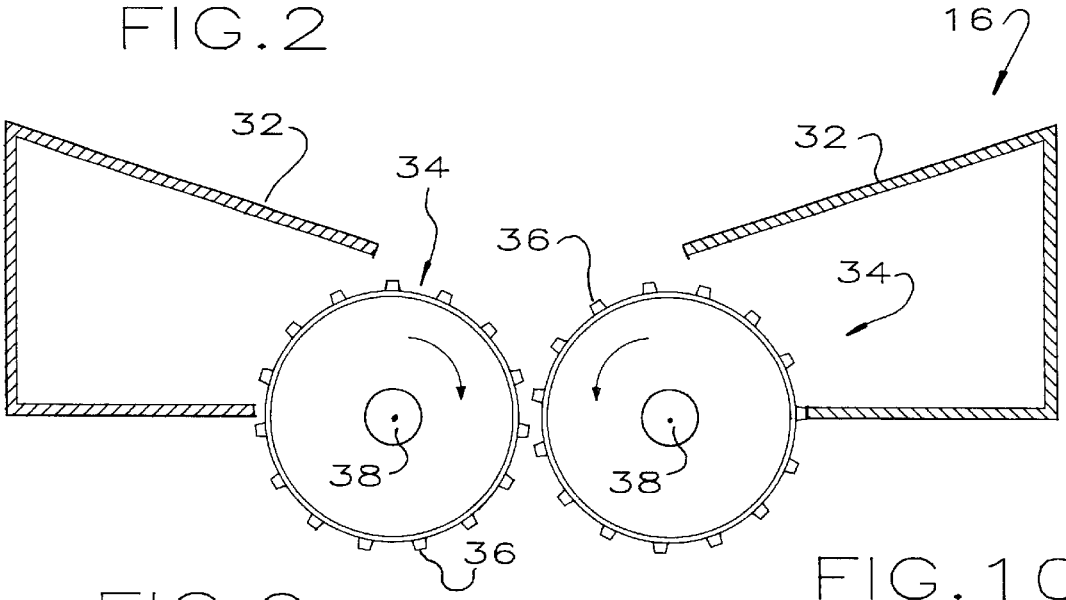
FIG. 2 is an enlarged cross-sectional view of one embodiment of a crimper used in this invention to break the core into smaller pieces without severing the bast fibers.

One embodiment of the crimper 16 is shown in FIG. 2 where the crimper 16 comprises a hopper or inlet 32 sloping downward to a pair of counterrotating cylinders 34 having teeth or ribs 36 extending outwardly from the cylinders 34. The cylinders 34 are driven about their axes 38 so the teeth or ribs 36 interdigitate but do not meet like scissor blades. Thus, the kenaf pieces pass through the bight between the cylinders 34 and the core is crimped or broken between the teeth 36 but the fiber is not broken.

Figure 3:
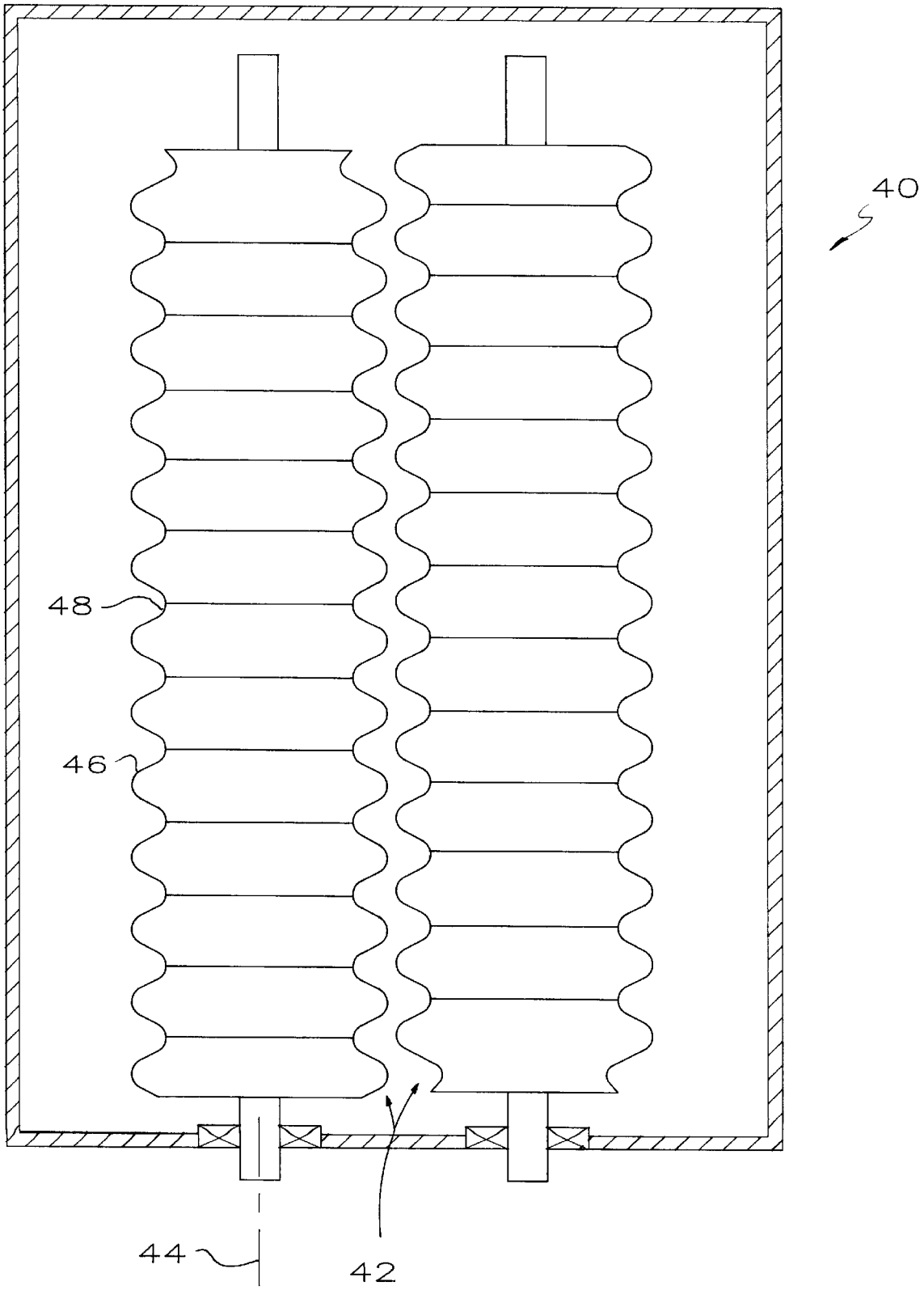
FIG. 3 is an enlarged top view of another embodiment of a crimper used in this invention to break the core into smaller pieces without severing the bast fibers.

Referring to FIG. 3, there is illustrated another embodiment 40 of a crimper. A potential difficulty with the crimper 16 is the kenaf pieces can theoretically fall horizontally between the cylinders 34 so the interdigitated teeth 36 are ineffective. The crimper 40 includes an inlet hopper (not shown) feeding kenaf pieces into the bight between a pair of horizontal corrugated cylinders 42 mounted for rotation about axes 44 in suitable bearings. The corrugated cylinders 42 include large ribs 46 merging smoothly with valleys 48. The adjacent cylinders 42 are positioned so the ribs 46 of one of the cylinders nest with the valleys 48 of the other cylinder and the gap between the surfaces of the cylinders 42 is essentially the same throughout the length of the nested periphery. The gap is less than the smallest diameter of kenaf expected to be run through the crimper 40. Thus, the gap is typically slightly smaller than ¼". The core of kenaf pieces moving horizontally through the crimper 40 are broken by the undulations in the cylinders 42. The core of kenaf pieces moving vertically through the crimper is crushed. Either of these variations acts to loosen the bond between the bast fibers and the core. It will be evident that the bast fibers are not severed by either of the crimpers 16, 40. It will also be apparent that other versions of crimpers may be employed.

After passing through the crimper 16 or the crimper 40, the kenaf is conveyed to the next operating station by the conveying system 18. The conveying system 18 is of any suitable design and may comprise a forced air system for blowing the kenaf toward the next station, a vacuum system drawing the kenaf toward the next station or a combination of both. As illustrated, the conveying system 18 comprises a series of conduits 50 extending between one operating station and the next and a series of air separator-exhaust fan assemblies 52. The assemblies 52 each include a separator housing 54 receiving kenaf and air from a previous operating station through an inlet 56, an exhaust fan 58 delivering air out of an outlet 60 and a kenaf outlet 62. The assemblies 52 are commercially available, such as from Lummus Corporation of Savannah, Ga.

In the event a forced air system is used, or partially used, the conveying system 18 includes a series of air injectors 64 inject compressed air into the conduit 50. The air injectors 64 are of conventional designed, used in the cotton industry to inject compressed air into conduits to convey unginned cotton toward a gin. Commercial devices are available from Consolidated Gin Company of Lubbock, Tex. The injector 64 is connected to the conduit 50 and conveys the cut, crimped kenaf to the next separator assembly 52.

Downstream of the separator assembly 52 is an air lock 66 which is also conventional equipment used in the cotton ginning industry for delivering kenaf to the downstream operational unit without delivering a large amount of air. Conventional air locks are available from Consolidated Gin Company of Lubbock, Tex. The air lock 66 delivers kenaf into the feed controller 20.

The stick machine 24 is preferably operated under steady flow conditions rather than pulsing or surging flow conditions. The feed controller 20 accordingly receives kenaf under pulsating or surging conditions and delivers kenaf under relatively steady flow conditions. The feed controller 20 is commercially available, such as from Consolidated Gin Company of Lubbock, Tex.

Downstream of the feed controller 20 is a conventional drier 22 where the moisture content of the kenaf is reduced to levels which promote separation. The drier 22 may be of any suitable type, such as is available commercially from Samuel Jackson, Inc. of Lubbock, Tex. known as a fountain drier or from Continental Gin Company of Pratville, Ala. known as a tower drier.

Figure 4:
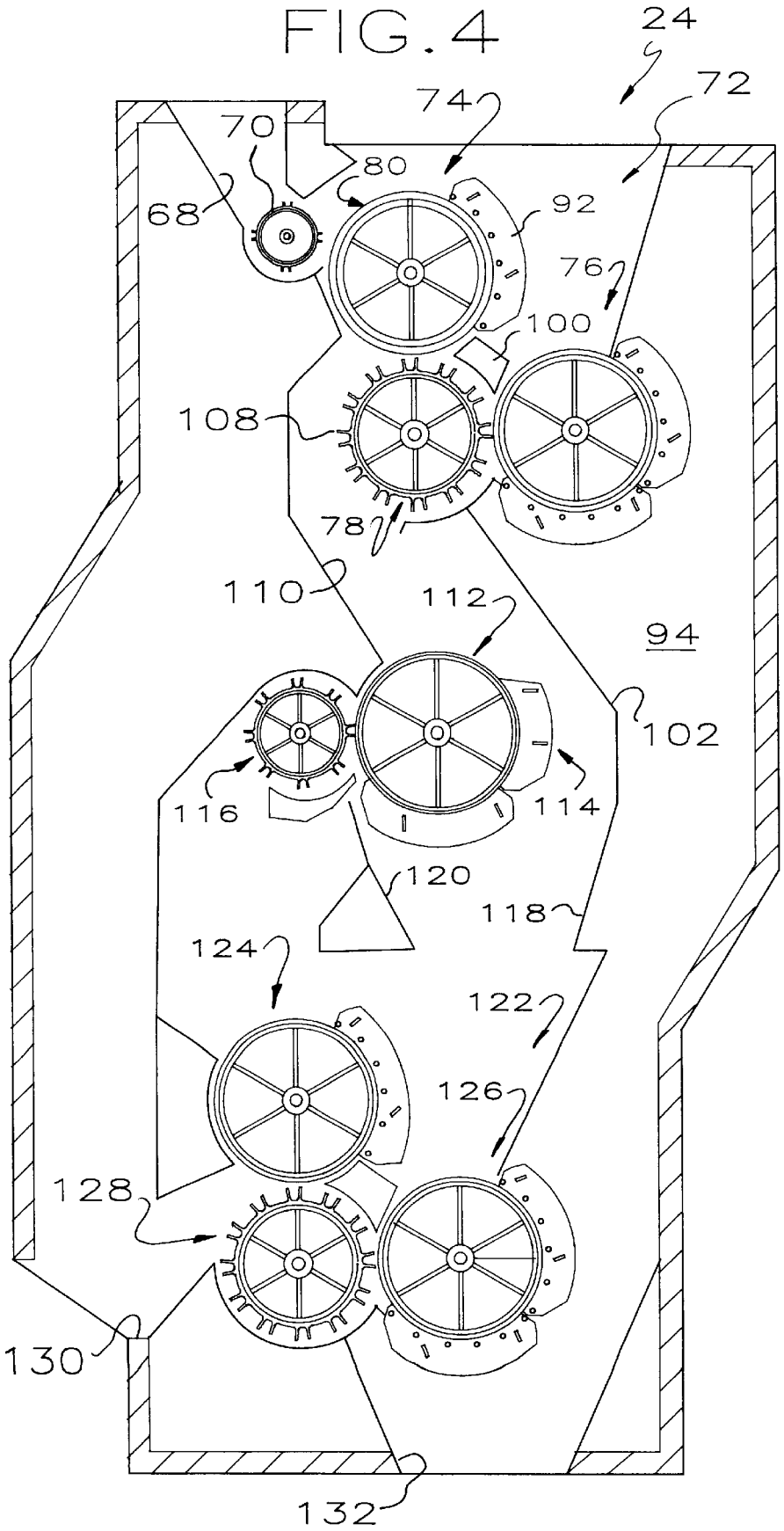
FIG. 4 is an enlarged vertical cross-sectional view of a fiber-core separator of the plant of FIG. 1.
Figure 5:
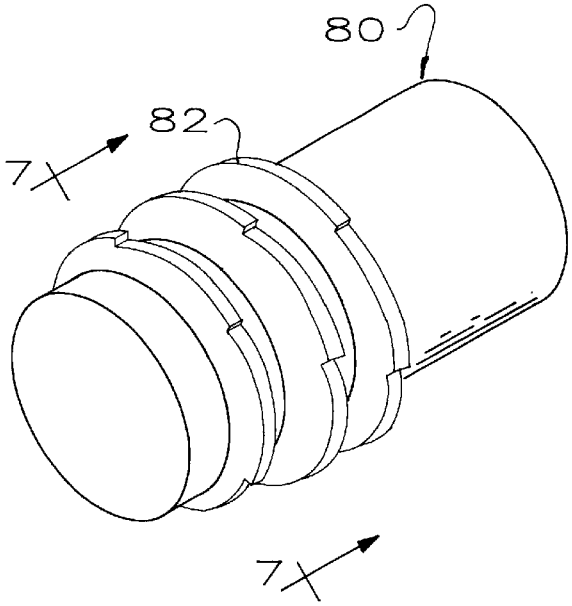
FIG. 5 is an enlarged partial isometric view of the saw cylinder in the separator of FIGS. 1 and 4.
Figure 6:
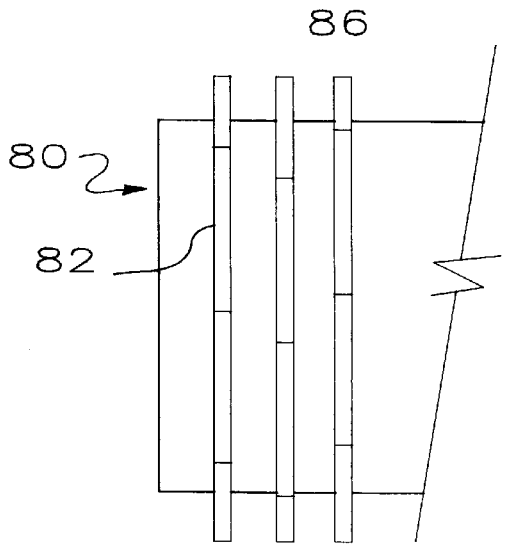
FIG. 6 is side view of the saw cylinder shown in FIG. 3.

As shown best in FIG. 4, the stick machine 24 is basically a conventional device used to remove cotton stalks, twigs and the like from unginned cotton. A modern design is shown in U.S. Pat. No. 4,974,293 and comprises an inlet chute 68 with or without a feed wheel 70 delivering product to a first operating assembly 72 including at least one, and preferably two, saw cylinder-grate assemblies 74, 76 and a doffing wheel 78. As shown in more detail in FIGS. 5–7, the saw cylinder-grate assembly 72 is of conventional design and is illustrated as comprising a saw cylinder 80 having a series of saw blades 82 providing teeth 84 presenting a sharp edge on the forward edge as it rotates in a clockwise direction shown in FIG. 7. The saw blades 82 are spaced apart by disks 86 and the teeth 84 are preferably staggered as shown in FIGS. 5 and 6. Other conventional saw cylinders include teeth provided on a cylindrical band which is bolted to the cylinder. The size, shape and spacing of the teeth 84 are subject to variation in an attempt to match the equipment with the desired length of fiber passing through the stick machine 24.

Figure 7:
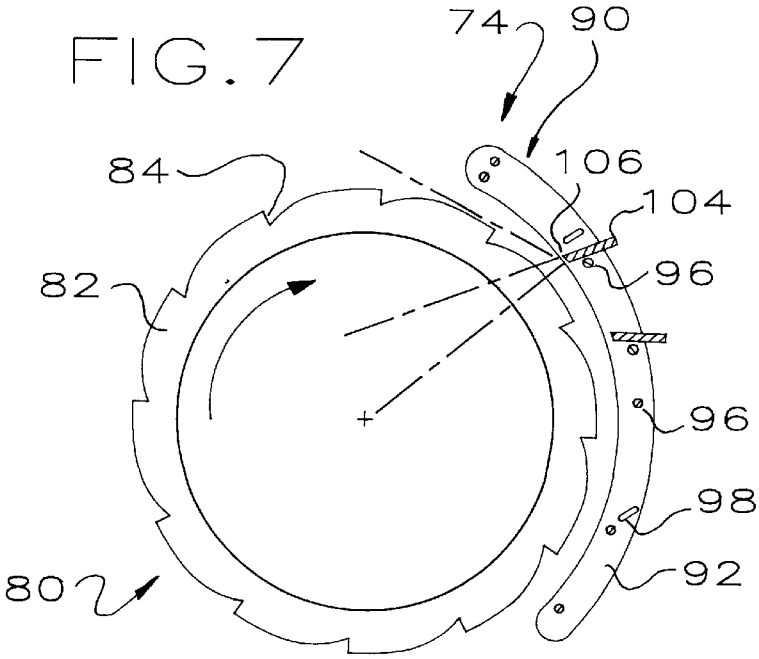
FIG. 7 is a cross-sectional view of the saw cylinder and grate of FIG. 5, taken along line 7—7 thereof as viewed in the direction indicated by the arrows.

The assembly 72 also includes a grate 90 comprising a pair of brackets 92 affixed to a side wall 94 of the stick machine 24 and a series of round bars or pipe sections 96 extending across the length of the saw cylinder 80 as shown best in FIG. 7. The bracket 92 is adjustably mounted toward and away from the saw cylinder 80 by one or more adjustment slots 98. In conventional operation, the bast fiber of kenaf pieces are snagged by the rotating teeth 84 of the saw cylinder 80 of the first assembly 72 and drug across the bars 104 thereby dislodging core pieces from the snagged fiber. The core pieces pass through the gaps between the bars 104 and are deflected by a baffle 100 toward the second assembly 76.

The assembly 76 is preferably generally identical to the assembly 74. Thus, any fibers adhering to the core pieces passing through the grate 90 of the first assembly 74 are snagged by teeth 84 of the second assembly 76 and drug across its grate dislodging further core from the snagged fibers. All core pieces passing through the grate 90 of the second assembly 76 are directed by partition walls 102 toward the bottom of the stick machine 24. Although there is some amount of fiber in it, a core rich stream of material exits the operating assembly 72 and falls by gravity toward the bottom of the stick machine 24. Although not generally needed, a controlled downdraft of air can be created inside the stick machine 24 to facilitate downward movement of the core particles from the assembly 76.

There is a tendency for the kenaf pieces to become jammed between the rotating saw cylinders 80 and the grates 90. When this occurs, an observer will see product entering the stick machine 24 but little or nothing coming out. The only thing to do is stop operation, open one or more of the side panels 94, 102, visually determine where the blockage is and pull the jammed kenaf from the saw cylinder. An important part of this invention is a modification to the grate 90 comprising one or more plates or straps 104 to ameliorate this problem.

The straps 104 are conveniently welded to one of the bars 96, preferably at an angle between perpendicular to the saw cylinder 80 and tangential to the periphery of the saw blades 82, as suggested in FIG. 7. The ends of the straps 104 facing the saw cylinder 80 are preferably slightly inclined to present a relatively sharp edge 106 which is conveniently generally tangential to the saw blades 82. The straps 104 act to dislodge core pieces stuck onto the teeth 84 and allow them to pass through the grates 90. Otherwise, these lodged core pieces will be removed by the doffing wheel 78 and directed into the fiber rich stream. The edges 106 also act to assist in dislodging core pieces from the snagged fibers. Thus, the straps 104 minimize jamming of product between the saw cylinders 80 and the grates 72 thereby minimizing down time and increasing throughput.

Figure 8:
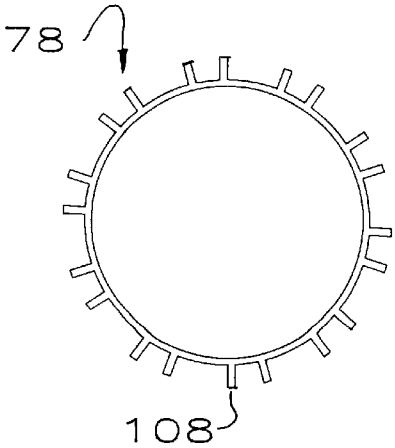
FIG. 8 is an enlarged side view of a doffing wheel.

Fibers snagged on the teeth 84 of the first and second assemblies 74, 76 are removed by the doffing wheel 78 in the conventional manner of doffing wheels. As shown in FIG. 8, the doffing wheel 78 includes metal or fiber fingers 108. In the bight where they meet, the doffing wheel 78 is rotating in the same direction but considerably faster than the saw cylinders 80 so the fibers snagged on the teeth 84 are removed as the periphery of the doffing wheel 78 moves past the saw cylinders 80. Thus, there is a fiber rich stream of material exiting the operating assembly 72. A visual inspection of the core rich and fiber rich streams shows some fiber in the core rich stream and considerably more core in the fiber rich stream.

Fiber removed from the doffing wheel 78 is directed by suitable ducts 110 to a second operating assembly 112 comprising a saw cylinder-grate assembly 114 and a doffing wheel 116. The second operating assembly 112 is illustrated as having a single saw cylinder-grate assembly 114 although a multiple assembly may be desirable. Again, fibers are snagged by the teeth on the assembly 114 and pulled past the grate dislodging another batch of core from the fiber. A second core rich stream falls between a partition wall 118 and a baffle 120 toward a third operating assembly 122. Fibers snagged by the saw teeth on the assembly 114 are doffed off by the doffing wheel 116 so a fiber rich stream with considerably less core material falls toward the third operating assembly 122.

The third operating assembly 122 is conveniently identical to the first assembly 72 and includes first and second saw cylinder-grate assemblies 124, 126 and a doffing wheel 128. The baffle 120 is positioned to direct the second core rich stream onto the second saw cylinder-grate assembly 126 and to direct the fiber rich stream onto the saw cylinder-grate assembly 124. The assemblies 124, 126 operate to pull the bast fibers from the core pieces and/or break the core pieces off the bast fibers in the manner described previously. Fibers snagged on the teeth of the assemblies 124, 126 are doffed off by the doffing wheel 128 and exit through a fiber outlet 130.

The first core rich stream falls along the partition wall 102 to the bottom of the stick machine and does not pass through the downstream operating assemblies 112, 122. The second core rich stream passes through the saw cylinder-grate assembly 126. Any fiber that is snagged by the saw teeth is removed by the doffing wheel 128 and passes to the outlet 130. Core material passes through the grate into a core outlet 132.

The core passes through the outlet 132 and through an air lock 134 into the core handling assembly 26. The core handling assembly 26 may be of any suitable type, such as a facility to collect and bag the core for sale.

Figure 9:
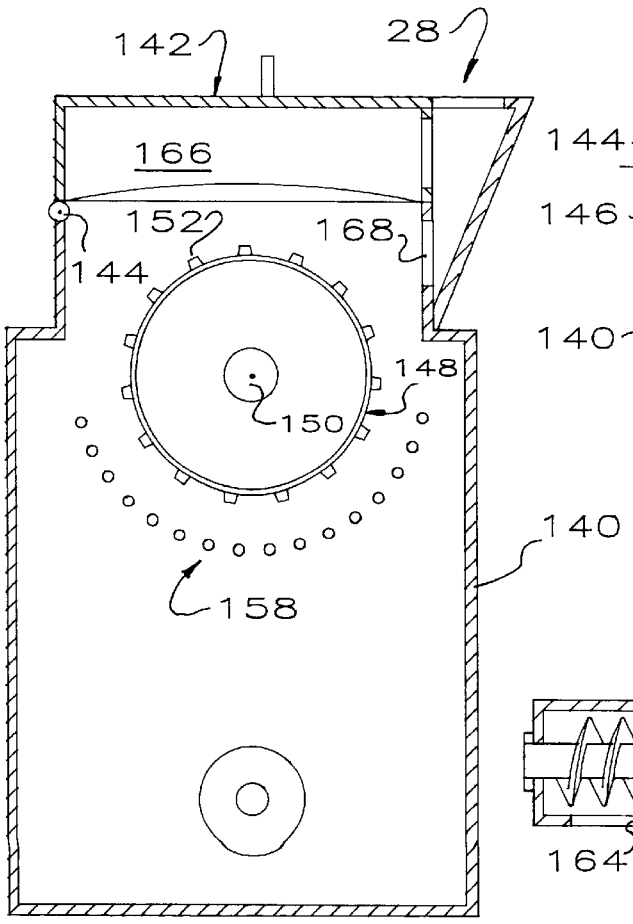
FIG. 9 is a vertical cross-sectional view of a secondary separator.
Figure 10:
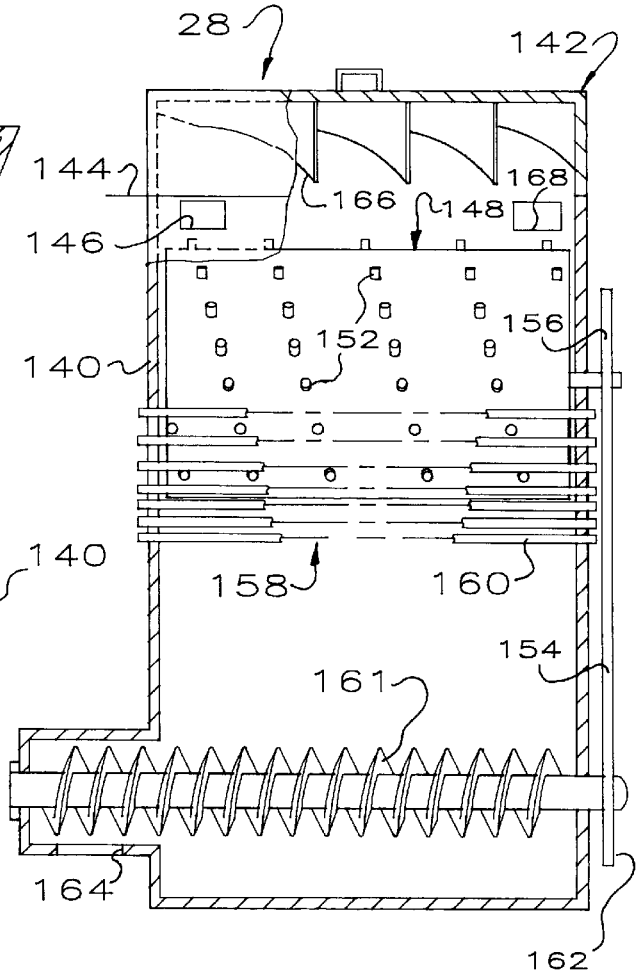
FIG. 10 is a side view of the second separator of FIG. 9, certain parts being broken away for clarity of illustration.

Fiber exiting from the outlet 130 passes through an air lock 136 into an air injector 138 which injects compressed air to propel the bast fibers through the final separating assembly 28. Observation of the fiber exiting from the stick machine 24 shows mainly fiber but a few pieces of core. Oddly, the core pieces are not tenaciously adhered to fibers. Instead, the core pieces are loose. Thus, the fibers have been removed from the core but the few remaining core pieces have not been separated from the fiber in the stick machine 24. The final separating assembly 28 may be a supermote cleaner known in the cotton industry but is preferably as shown in FIGS. 9–10.

The final separating assembly or separator 28 is preferably of a type that operates by opening up the fibers from a mass or mat into a loose fluffy condition where the denser core pieces are free to move downwardly by gravity through the fluffy fibers. As shown in FIGS. 9–10, the separator 28 comprises a housing 140 having a pivotal lid 142 mounted for movement about an axis 144 from a position closing the top of the housing 142 to a position allowing access to the interior. Fiber and air from the injector pass through an inlet opening 146 into the interior of the housing. A drum 148 is mounted for rotation about an axis 150 and includes a series of upstanding pegs 152 arranged in a helical fashion on the exterior of the drum 148. The drum 148 is driven by a belt 154 extending about a pulley 156 and driven by motor (not shown).

A grate 158 comprises a series of bars 160 arranged in a semi-circle under the drum 148 and allows core particles to drop into an auger or other conveyor 161 driven by a pulley 162 operated by the belt 154. Thus, core particles are conveyed toward an outlet 164 for delivery to the core handling facility 26.

An important part of this invention is the provision of diagonal baffles 166 in the lid 142. The baffles 166 incline in the same direction as the helix defined by the pegs 152. One function of the lid 142 is to provide a substantial volume above the drum 148 to allow the bast fibers to expand thereby allowing the loose core pieces to fall downwardly. The core pieces accordingly fall toward the surface of the drum 148 or on the outside of the drum, directly onto the grate 158. Those core pieces that fall onto the drum are no longer entangled with bast fibers and are prone to fall off the drum as it rotates.

One function of the baffles 166 is to lengthen the travel path through the separator 28 so the fibers do not travel directly from the inlet 146 to the outlet 168. The fibers are prone to travel in a loop dictated by the baffles 166 and are typically dragged by the pegs 152 and blown by the air travelling through the housing 140.

The amount of air travelling through the separator 28 is insufficient to propel the fiber through the housing 142. Instead, travel of the fiber is caused both by air movement and by mechanical propulsion caused by the pegs 152 which, because of their helical arrangement, nudge the fibers toward the outlet 168.

Air and fiber leave the separator 28 through a conduit 170 to an air separator-exhaust fan assembly 172 having an exhaust fan 174 delivering air out of an outlet 176 and a kenaf outlet 178. The air supplied to the separator 28 is balanced, i.e. the volume of air delivered by the injector 138 is the same as the volume of air withdrawn by the exhaust fan 174. Thus, there is little or no air movement into or out of the core outlet 164 or the housing 140 even though the lid 142 is unsealed.

The fibers leave the assembly 172 through an air lock 180. If the bast fibers are being used at the site of the plant 10, the manufacturing facility may receive fibers from the air lock 180. In the alternative, the bast fibers are delivered to a bagging or module building device 182 where the bast fibers are collected and processed for shipment.

This invention allows for the separation of kenaf into its constituent fiber and core on an industrial scale. This invention has succeeded in the face of numerous failed attempts in the prior art to process kenaf on an industrial scale.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of separating kenaf into its constituents of fiber and core comprising the steps of delivering lengths of kenaf onto a periphery of a saw cylinder comprising a multiplicity of spaced apart teeth;

rotating the saw cylinder and snagging the fiber on the teeth, moving snagged lengths of kenaf into contact with a grate and delivering pieces of core through the grate thereby separating the core from the fiber; and removing the fiber from the saw cylinder.

2. The method of claim 1 further comprising breaking the core into lengths substantially shorter than the fiber before delivering the kenaf onto the periphery of the saw cylinder.

3. The method of claim 2 wherein the core is substantially weaker in bending than the fiber and the breaking step comprises bending the lengths of kenaf and snapping the core into sections without severing the fiber.

4. The method of claim 3 wherein the bending step comprises crimping the lengths of kenaf.

5. The method of claim 1 wherein the method is conducted inside a stick machine having an inlet, a particulate outlet and a fiber outlet and wherein core is delivered through the particulate outlet and fiber is delivered through the fiber outlet.

6. The method of claim 1 further comprising subjecting the core to another separation operation by directing pieces of core, delivered through the first mentioned grate, onto a periphery of a second saw cylinder comprising a multiplicity of spaced apart teeth;

rotating the second saw cylinder and snagging fiber on the teeth, moving snagged lengths of kenaf into contact with a second grate and delivering pieces of core through the second grate thereby separating the core from the fiber; and removing the fiber from the second saw cylinder.

7. The method of claim 6 further comprising subjecting the fiber to another separation operation by directing fiber, removed from the first saw cylinder, onto a periphery of a third saw cylinder comprising a multiplicity of spaced apart teeth;

rotating the third saw cylinder and snagging fiber on the teeth, moving snagged lengths of kenaf into contact with a third grate and delivering pieces of core through the third grate thereby separating the core from the fiber; and removing the fiber from the third saw cylinder.

8. The method of claim 7 wherein the removing step comprises removing the fiber from the third saw cylinder with a third doffing wheel.

9. The method of claim 6 wherein the removing step comprises removing the fiber from the second saw cylinder with a second doffing wheel.

10. The method of claim 1 further comprising subjecting the fiber to another separation operation by conveying fiber, removed from the first saw cylinder, with air through a conduit of predetermined cross-sectional area and into a separator having therein a rotating drum providing a series of helically arranged pegs;

rotating the drum and advancing the fiber toward an outlet through a flow path having a substantially larger cross-sectional area than the cross-sectional area of the conduit and thereby decreasing the velocity of the fiber and expanding the fiber;

allowing core pieces to fall out of the fiber; and separately collecting the fiber and the core.

11. The method of claim 1 wherein the removing step comprises removing the fiber from the saw cylinder with a doffing wheel.

12. The method of claim 1 wherein the saw cylinder comprises a plurality of spaced apart toothed wheels.

* * * * *